United States Patent [19]

Elkuch

[11] 3,971,224

[45] July 27, 1976

[54] METHOD FOR ERECTING A PILE WALL ADAPTED TO TAKE COMPRESSIVE FORCES AND A PILE WALL PRODUCED BY THE METHOD

[76] Inventor: Erwin Elkuch, Toniaulestr. 10, FL-9490 Vaduz, Liechtenstein, FL 9490

[22] Filed: Nov. 20, 1974

[21] Appl. No.: 525,295

[30] Foreign Application Priority Data

Nov. 26, 1973 Austria ..... 9906/73
Oct. 15, 1974 Austria ..... 8282/74

[52] U.S. Cl. ..... 61/41 A; 52/359; 52/489

[51] Int. Cl.[2] ..... E21D 5/00

[58] Field of Search ..... 61/58, 60, 61, 62, 41 A; 52/489, 357, 358, 359, 360, 361, 362, 363, 364, 484, 548, 549, 480, 395, 582

[56] References Cited

UNITED STATES PATENTS

| | | | |
|---|---|---|---|
| 464,172 | 12/1891 | Dean | 61/60 UX |
| 1,831,426 | 11/1931 | Schroeder | 61/60 |
| 1,923,906 | 8/1933 | Berger | 52/359 X |
| 1,951,293 | 3/1934 | Cahill | 61/62 X |
| 2,160,711 | 5/1939 | Balduf | 52/357 |
| 2,347,961 | 5/1944 | Olsen | 52/362 X |
| 2,353,455 | 7/1944 | Gisondi | 52/548 |
| 2,676,481 | 4/1954 | Hoffman | 52/395 X |
| 3,305,994 | 2/1967 | Amrhein et al. | 52/489 |
| 3,339,329 | 9/1967 | Berg | 52/395 |
| 3,464,167 | 9/1969 | Mason | 52/489 UX |
| 3,490,242 | 1/1970 | Schnabel | 61/49 X |
| 3,511,011 | 5/1970 | Straus | 52/489 X |
| 3,577,694 | 4/1971 | Omholt | 52/489 X |
| 3,713,264 | 1/1973 | Morgan | 52/489 |

FOREIGN PATENTS OR APPLICATIONS

| | | | |
|---|---|---|---|
| 880,508 | 10/1961 | United Kingdom | 61/41 A |

*Primary Examiner*—Dennis L. Taylor
*Attorney, Agent, or Firm*—Lackenbach, Lilling & Siegel

[57] ABSTRACT

The invention starts from the known method of erecting a pile wall adapted to take compressive forces, from spaced piles and bridging piles cross-connected thereto and intended to close the initially free zones between the spaced piles.

19 Claims, 7 Drawing Figures

II
21-21
2
26
27
23
22
21
9
91
8
24
25
4
3
1

METHOD FOR ERECTING A PILE WALL ADAPTED TO TAKE COMPRESSIVE FORCES AND A PILE WALL PRODUCED BY THE METHOD

SUMMARY OF THE INVENTION

Starting from this method of producing a pile wall consisting of spaced, individual or clustered piles and bridging piles which are crossconnected thereto and which are intended for initially free zones which are subsequently closed by the bridging piles, the present invention is characterised in that the bridging piles are suspended from spaced piles constructed as vertical piles, being suspended from those boundary surfaces thereof which are remote from the pressure, and being locked automatically and positively against any further movement.

Accordingly, a pile wall produced by the method, is characterised by the provision of recesses in the spaced piles, which are constructed in the form of vertical piles, in conjunction with brackets which, on that side of the vertical piles which is remote from the pressure, are constructed to be movable through the recesses in the vertical pile and which form a bearing surface for the bridging piles, said bearing surface being situated on the side remote from the pressure, so that when the brackets are in the operative position they are subjected to an anti-clockwise torque.

The present invention is thus based on the finding that it is not necessary for the spaced piles to be driven into the subsoil for civil engineering purposes after the style of the sheet-piles of sheet-pile walls instead, particularly for building construction purposes, it may be quite sufficient for the said spaced piles to be constructed as vertical piles, this term being used in this context to denote any pile assuming a specific position in space irrespective of the nature of the steps maintaining these piles in their respective position to give them stability. The vertical piles can therefore be provided with baseplates which bear them, the vertical piles may be inserted, keyed or screwed into vertical pipes, if bases are used which internally match the section of the vertical piles and which are externally screwthreaded, they can be driven into the soil, they can be poured, pressed, or secured by dowels in concrete or metal block foundations, they can be held by separate bearing structural elements such as scaffolding tubes, bearers projecting beyond fixed building walls, etc, or otherwise be fixed and retained in any required position.

In development of this principle of the invention, the movement for placing and locking the bridging piles is composed of an initial lifting movement with simultaneous abutment of the bridging piles against the vertical piles, the distance between which is to be bridged, the said bridging piles abutting the said vertical piles at those boundary surfaces which are remote from the pressure, the initial movement being followed by a dropping movement on the part of the bridging pile.

Advantageously, each further pile bridging the same zone between the vertical piles is subjected to such a combined movement, disregarding the bridging of other initially free zones between verticl piles.

To enable the wall to take the pressure exerted by the liquids, such as water, or by substances of a behaviour similar to liquids, such as river sand, peat or building materials which have not yet set, such as concrete, mixtures of concrete and gravel, pasty and watery cement, plaster and other synthetic material mixtures etc., the said wall must be sealed, particularly in respect of its recesses, either by providing the pile wall with impenetrable curtains, for example polyethylene sheeting curtains, cap or plug closures for the recesses in the pile wall and/or by sealing the cross-bond between the vertical and bridging piles by means of seals disposed on and between the same, more particularly sealing strips, while in the case of sacrifice formwork iron or steel piles can be welded together for this purpose.

The further construction of a pile wall made by the method from spaced, individual or clustered piles and bridging piles which are cross-connected thereto and which are intended for initially free zones which are subsequently closed by the bridging piles, and with the provision of recesses in the spaced piles, which are constructed in the form of vertical piles, in conjunction with brackets which, on that side the vertical piles which is remote from the pressure, are constructed to be movable through the recesses in the vertical pile and which form a bearing surface for the bridging piles, said bearing surface being situated on the side remote from the pressure, so that when the brackets are in the operative position they are subjected to an anti-clockwise torque, is characterised according to the invention in that the bridging piles have a S-shaped cross-section with edge zones bent hook-fashion and another zone situated between the edge zones and hereinafter referred to as the intermediate zone for short, within which intermediate zone there is a cranked portion which is responsible for the S-shape, followed by zones which extend in plane-parallel relationship to that boundary surface of the vertical piles which is remote from the pressure.

Advantageously, the vertical pile itself has a corrugated cross-sectional shape which corresponds to the pattern of the letter "W" and which has flat zones at the places corresonding to the reversal points of the comparative letter, with the difference that the flat zones of the vertical pile section divided by the central plane of symmetry through the vertical pile section are at a distance from the edge flat zones which is approximately twice the distance of the latter from the edge flanges terminating the section. The advantage of this is that space is available on that boundary surface of the vertical pile which is adjacent the pressure, to accommodate the brackets or suspension means which may alternatively be referred to as suspension hooks because of their shape, and this means that the work is eliminated which would otherwise be required to accommodate in these surroundings, for example the soil, the bracket or suspension hook limbs projecting beyond those boundary surfaces of the vertical pile which are adjacent the pressure.

BRIEF DESCRIPTION OF THE DRAWINGS

One exemplified embodiment of the invention is illustrated in the accompanying drawing. In this exemplified embodiment the vertical piles are constructed as driven piles.

DETAILED DESCRIPTION OF THE PREFERRED EMBODIMENTS

Figures 1, 2:
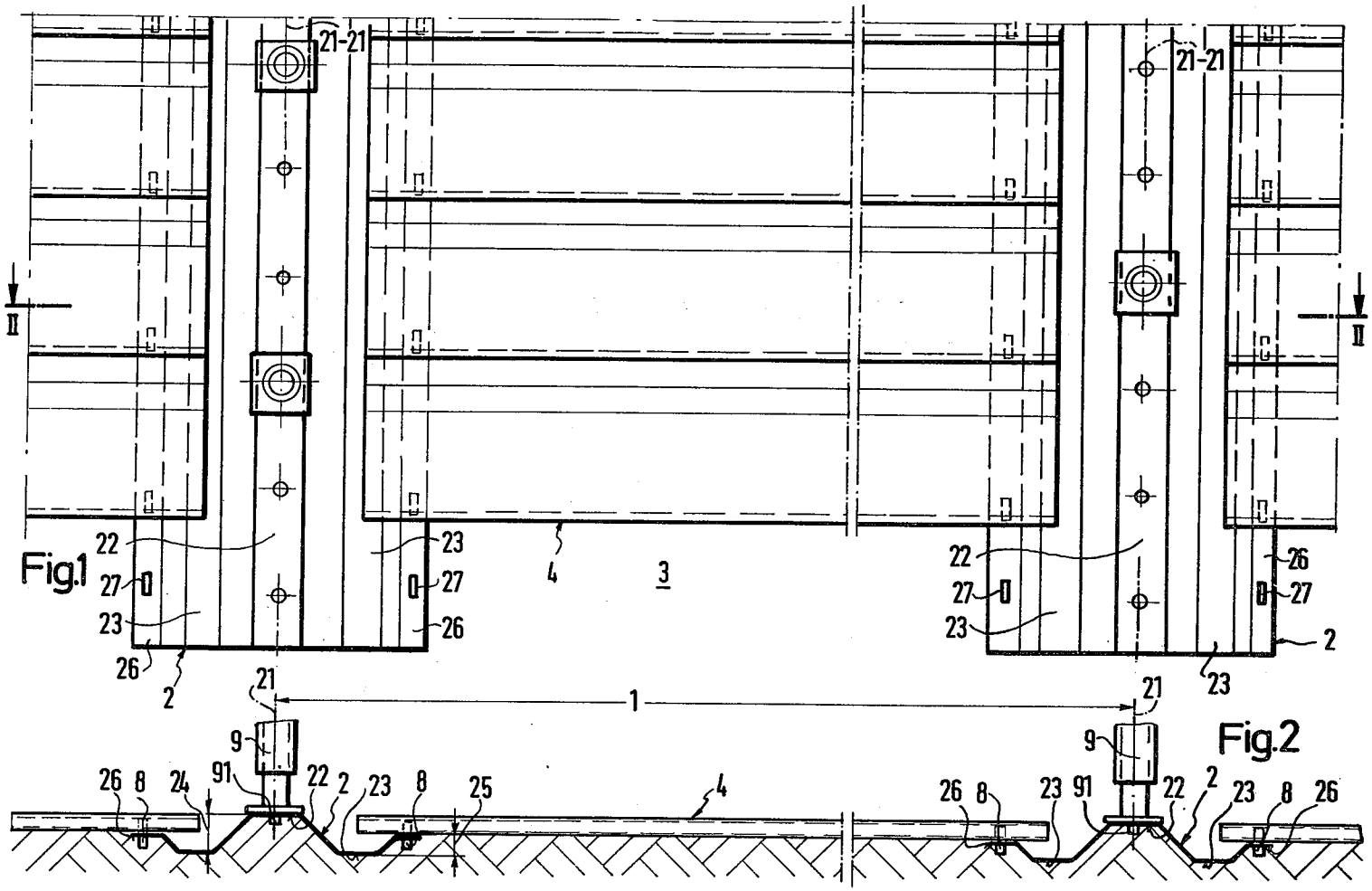
FIG. 1 of the drawing is a plan view of a pile wall constructed according to the invention, which wall may also be termed a sheet-pile wall when sealing means (not shown), more particularly sealing strips, are provided for the joints between the bridging piles.
FIG. 2 is a horizontal section on the line II—II of FIG. 1.

Referring to FIG. 1 of the drawing, reference 1 denotes the intervals between the driven piles 2, such intervals being provided because the initially free zones 3 between the driven piles 2 are to be bridged by piles 4 which are therefore referred to hereinafter as bridging piles. The advantage of spacing the driven piles 2 from one another and bridging the initially free zones which are subsequently closed by the bridging piles 4 is elimination of the locks otherwise required for the erection of closed pile walls having interlocking driven piles.

FIG. 2 of the drawing shows that the driven piles 2 have a W-shaped section, the driven piles being symmetrical with respect to a central plane 21—21. It will be apparent that a first difference from the comparative letter "W" is that flat zones 22 and 23 are provided instead of the reversal points in the comparative letter, while the second difference is that while the middle limb of the comparative letter has a relatively short height, the height 24 of the flat zone 22 from the flat zone 23 of the generally corrugated section is twice the height 25 between the flat zones 23 and the end flanges 26 which terminate the driven pile section. Since the recesses 27 which are provided in vertical rows in the flanges 26 (see FIG. 1) are intended to receive the suspension hooks 8 for the bridging piles 2 as shown in FIGS. 3 and 4, the result of the proposed construction of the driven pile section is that the limbs 81 of the suspension hooks 8 visible in the said Figures can be accommodated without difficulty because when the piles 2 having the section shown in FIG. 2 are driven, it is inevitable that there will be crumbling of the soil situated beneath the flanges 26 with reference to FIG. 2 with the result that the limbs 81 of the hooks 8 — insofar as they project beyond the pressure-receiving boundary surface 28 of the driven pile section flanks 26 — can pass through the recesses 27 in the crumbled surroundings, e.g. soil, as they are pressed in, without further accommodation being required.

Figure 3:
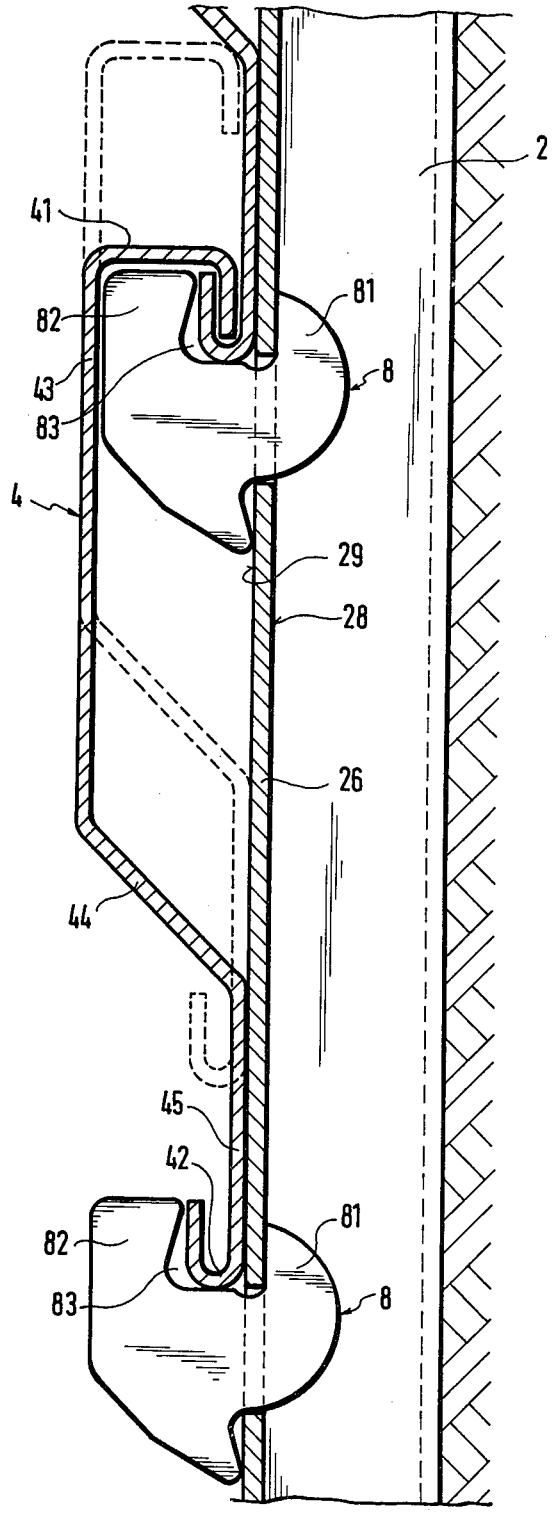
FIG. 3 is a cross-section to an enlarged scale through a bridging pile according to the invention.
Figure 4:
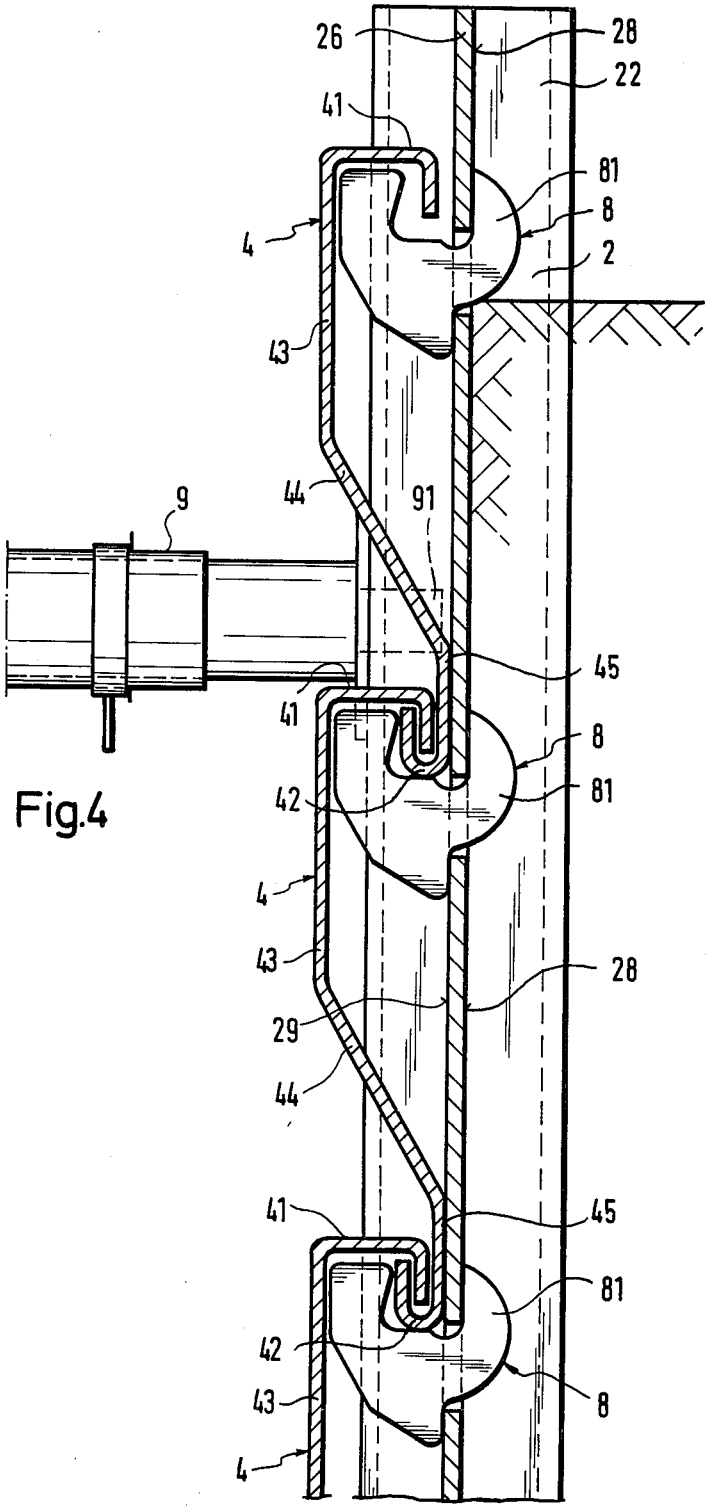
FIG. 4 shows a plurality of bridging piles disposed vertically one beneath the other to show more clearly the individual stages of the placing operation.

FIGS. 3 and 4 show the section of the bridging piles 4. The top and bottom flanks of the bridging piles have edge zones 41, 42 which are bent to be hook-shaped. Extending downwardly, the curved edge zone 41 is followed by a zone 43 over which the bridging piles 4 have a wall zone which extends in plane-parallel relationship to the boundary surface 28 of the driven piles 2 bridged by the piles 4. This zone is followed by a cranked zone 44 which is again followed by a flat zone 45 which merges into the curvature 42. This construction of the bridging piles 4 enables them to be placed by bringing them into the position shown in broken lines in FIG. 3 which enables them to be moved over the limb 82 of the suspension hooks 8 which have already been engaged in the recesses 27. The flat zone 45 enables the bridging pile 4 to be slid downwards along those boundary surfaces 29 of the driven piles 2 which are remote from the pressure, the zones between the driven piles still being free and requiring to be bridged by the pile illustrated in FIG. 3. Lowering of the pile 4 from the broken-line position into the solid-line position does not entail the slightest difficulty therefore. In this position, the curved bottom edge zone 42 automatically engages in the recess 83 formed between the U-shaped limbs 81 and 82 of the suspension hooks 8. FIG. 3 clearly shows that the top curved edge zone 41 is simultaneously received in the same recess 83 and automatic locking of the bridging piles 4 in question is thus obtained both in the bottom and in the top zone.

FIG. 4 shows the general arrangement of a plurality of bridging piles which have already been placed. After the free zones between the driven piles have been closed as illustrated, the screw jacks 9 are used. These have end members 91 which are received in corresponding recesses in the flat zones 22 of the driven piles 2 (see FIG. 2), so that pits, trenches and other spaces produced by the excavation of soil and required for civil engineering purposes can be so braced by pile walls constructed according to the invention that it is impossible for soil to collapse into such spaces, so that labour is ideally protected against any danger of the walls' collapsing, or injury due to breakdown of the formwork.

Figure 5:
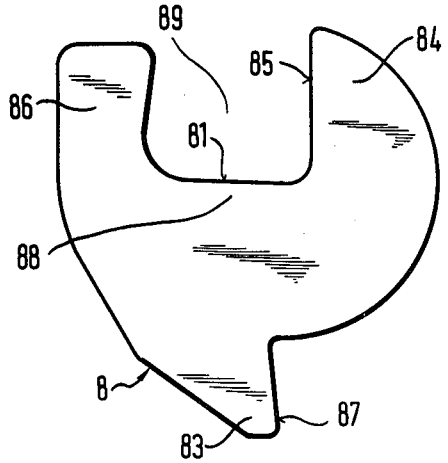
FIG. 5 is a side view of a steel bracket constructed as a suspension hook.
Figure 6:
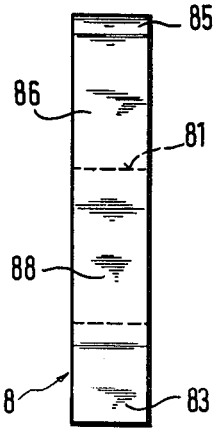
FIG. 6 is a front view thereof.

FIGS. 5 and 6 show the actual steel suspension hook 8 itself. It will be apparent that the basic shape of the hook is that of the Arabic number 4, the U-shaped top part being formed by the side limbs 84 and 86 which are interconnected by the bottom limb 88 and which together define the engagement area 89 for the bridging piles 4, while the bottom surface 81, when viewed perpendicularly to that surface 21 of the driven pile (FIG. 2) which is remote from the pressure, has a depth adequate to support two inter-engaged bridging piles.

Figure 7:
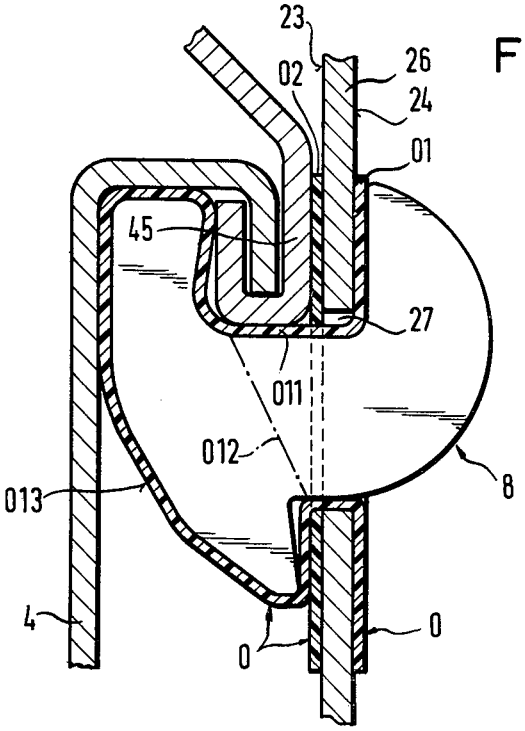
FIG. 7 shows the same with sealing means.

Sealing-means in the form of seals having the general reference 0 and consisting of high-elasticity materials, such as rubber or other elastomers, are provided to seal the slots 27. FIG. 7 shows a rubber plate 01 which covers the slot 27 formed in the driven pile wall 26 to receive the bracket 8, the said rubber plate covering the said slot over the entire extent of its zone not occupied by the bracket, in order to seal the slot with respect to the substance concerned and being subject to the pressure of the latter. In the middle, the rubber plate 01 is extended outwardly towards the bridging pile 4. The outwardly extending portion 011 either terminates at the dot-dash line 012 or else merges into the cap 013 which encloses the entire bracket 8, so that the same is protected completely not only against the substance concerned but also against corrosion. A co-acting sealing means in the form of a co-acting plate 02 of rubber is also provided. The limb 45 of the bridging pile 4 provides the counter-pressure for the rubber plate 02. There is not difficulty in covering the bracket 8 with the high-elasticity material of the sealing-means 01, 011, 013 and 02, particularly if lubricants such as talcum powder are used. The consistency and the excess pressure of the material which is to be sealed off will determine whether closed caps or outwardly extending portions terminating in open ends are to be preferred. In similar way there is a possibility for making tight, to seal resp. the bridging piles 4 in relation to each other. A further possibility is given by covering the bridging piles with high elasticity materials.

The invention covers not only each individual one of its indicated features — even if it has been mentioned only in conjunction with other features — but also each embodiable partial combination of the features, and also the total combination of all the features, insofar as individual features, partial combinations and/or the total combination are technically rational, practical and usable, even if the respective attainable novel technical effects are not mentioned and described in detail. All the discernible details mentioned in the description and/or the claims and/or illustrated in the drawing and any combinations of these details are covered as such, with their function or functions and with the functional relationship or relationships as described and claimed, provided they occur in partial combinations or in the total combination.

What is claimed is:

1. A method of erecting a retaining wall which is adapted to resist pressure exerted by a medium behind said retaining wall, said method comprising the steps of:

positioning a plurality of piles vertically at intervals in a substrate, inserting a plurality of suspension means in the form of hooks in apertures along the vertical side edges of said verticle piles, and closing the free zones between said vertical piles from the insides of said vertical piles remote from the medium by hanging a plurality of interconnecting bridging piles from said suspension hooks, the upper and lower edges of each bridging pile being engageable with adjacent suspension hooks on adjacent vertical piles so that said plurality of bridging piles are disposed generally perpendicular to the vertical piles, and whereby said suspension hooks lock said bridging piles to said vertical piles.

2. The method according to claim 1, wherein the hanging of said bridging piles from said suspension hooks includes the step of sliding downwardly each of said bridging piles so that said upper and lower edges enter into slots provided in said suspension hooks for locking the bridging piles to said vertical piles.

3. The method according to claim 1, including the step of sealing the horizontal joints between adjacent tiers of bridging piles by means of a sealing strip of an elastomeric material.

4. The method according to claim 1, including the step of sealing the suspension hooks and their mating apertures along the edges of said vertical piles by means of sealing plates of elastomeric material.

5. The method according to claim 1, wherein said vertical piles have a generally corrugated or cross-sectional shape as in the form of a W, and wherein flat zones are provided at the reversal points of the shaped piles and at the end points thereof.

6. The method according to claim 5, wherein the height of the end flat zones from the two flat zones at the reversal points is about half the height of the central flat zone from the two flat zones at the reversal points of the corrugated or W-shaped pile.

7. The method according to claim 1, including the step of providing shore braces for said retaining wall.

8. The method according to claim 7, wherein said shore braces are jacks disposed perpendicularly to said retaining wall.

9. The method according to claim 8, wherein said jacks are provided with end members received in recesses provided in said vertical piles.

10. A retaining wall adapted to resist pressure exerted by a medium behind said retaining walls comprising in combination: a plurality of vertically posed piles positioned at intervals in a substrate; suspension means in the form of hooks provided in apertures along the vertical side edges of said vertical piles; and interconnecting bridging piles, closing the free zones between said vertical piles, suspended from the insides of the vertical piles and from said suspension hooks; the upper and lower edges of each bridging pile being engageable with adjacent suspension hooks on adjacent vertical piles so that said bridging piles are disposed generally perpendicular to the vertical piles, whereby said suspension hooks lock said bridging piles to said vertical piles to generally form in appearance a continuous seamless bulkhead.

11. The retaining wall according to claim 10, wherein the suspension hooks are provided with an abutment surface which is adapted to preclude movement of the suspension hooks upon installation of said suspension hooks in said vertical piles.

12. The retaining walls according to claim 10, wherein said suspension hooks have a notch or cut-out portion on the top part thereof for permitting the upper and lower edges of adjacent bridging piles to be locked therein.

13. The retaining wall according to claim 10, wherein said vertical piles have generally corrugated or cross-sectional shape as in the form of a W, and wherein flat zones are provided at the reversal points of the shaped piles and at the end points thereof.

14. The retaining wall according to claim 13, wherein the height of the end flat zones from the two flat zones at the reversal points is about half the height of the central flat zone from the two flat zones at the reversal points of the corrugated or W-shaped piles.

15. The retaining wall according to claim 10, wherein said interconnecting bridging piles are generally S-shaped in cross-section with inwardly extending flange or hooks ends at both the upper and lower edges of said bridging piles.

16. The retaining wall according to claim 10, including a sealing strip in the form of an elastomeric material for sealing the horizontal joint between adjacent tiers of bridging piles.

17. The retaining wall according to claim 10, including sealing means in the form of an elastomeric material for sealing the suspension hooks and their mating apertures.

18. The retaining wall according to claim 17, wherein said sealing means is a highly elastic sealing plate adapted to stretch and cover a suspension hook.

19. The retaining wall according to claim 10, wherein said sealing means is in the form of a closed seal cap disposed about each aperture from the medium side of said retaining wall, and about that portion of said suspension hook which projects outwardly from said aperture toward the inside of said retaining walls.

* * * * *